US010156415B2

(12) United States Patent
Perdue

(10) Patent No.: US 10,156,415 B2
(45) Date of Patent: Dec. 18, 2018

(54) COMBINED CENTERFIRE SLINGBOW AND QUIVER

(71) Applicant: Jon Perdue, Washington, DC (US)

(72) Inventor: Jon Perdue, Washington, DC (US)

(73) Assignee: Global Force LTD, Guaynoba, PR (US)

( * ) Notice: Subject to any disclaimer, the term of this patent is extended or adjusted under 35 U.S.C. 154(b) by 513 days.

(21) Appl. No.: 13/902,913

(22) Filed: May 27, 2013

(65) Prior Publication Data

US 2014/0116407 A1 May 1, 2014

Related U.S. Application Data

(60) Provisional application No. 61/719,640, filed on Oct. 29, 2012.

(51) Int. Cl.
*F41B 5/00* (2006.01)
*F41B 5/14* (2006.01)

(52) U.S. Cl.
CPC ..... *F41B 5/0094* (2013.01); *F41B 5/1484* (2013.01)

(58) Field of Classification Search
CPC ..... F41B 1/00; F41B 5/0094; F41B 5/1484
USPC ..... 124/80
See application file for complete search history.

(56) References Cited

U.S. PATENT DOCUMENTS

| | | | | |
|---|---|---|---|---|
| 2,715,895 A | | 8/1955 | Loveless | |
| 2,807,254 A | | 9/1957 | Stribling | |
| 2,876,760 A | | 3/1959 | Halverson | |
| 3,018,770 A | | 1/1970 | Saunders | |
| 3,524,439 A | | 8/1970 | Dantzler | |
| 3,949,729 A | | 4/1976 | Pfotenhsuer | |
| 4,002,236 A | * | 1/1977 | Tolleson | 206/577 |
| 4,169,453 A | * | 10/1979 | Hunsicker | 124/20.1 |
| 4,465,054 A | * | 8/1984 | Nishioka | 124/25.6 |
| 4,573,445 A | * | 3/1986 | Webb et al. | 124/22 |
| 4,877,007 A | | 10/1989 | Olson | |
| 5,931,146 A | * | 8/1999 | Schrader et al. | 124/23.1 |

(Continued)

OTHER PUBLICATIONS

Wickersheim, Colleen. "The Avengers Homemade Hawkeye Costume ." Life Sprinkled With Glitter. Blogger, Sep. 27, 2012. Web. Nov. 6, 2014. <http://web.archive.org/web/20120927082840/http://lifesprinkledwithglitter.blogspot.com/p/the-avengers-homemade-hawkeye-costume.html>.*

*Primary Examiner* — Eugene Kim
*Assistant Examiner* — Jeffrey Vanderveen

(57) ABSTRACT

A compact slingbow/quiver combination including first and second arms joined by a generally central cross piece. Slingbow arms are interconnected by at least one latex band for projecting arrows. Central cross piece includes an internal centerfire aperture for receiving arrows for launching. A rest and guide element with pliable bristles is secured within the centerfire aperture to support arrows without damage to fletching. The band includes an intermediate nocking segment adjustably positioned at the centerfire aperture to engage arrow nocks. Slingbow arms include internal storage chambers. At least one chamber is configured as a quiver for arrow storage; other chamber(s) may store other items for the archer. The central cross piece projects rearwardly of the slingbow where it (1) receives an arrow for launch and (2) absorbs band impact thus avoiding wrist slap. Slingbow arms and central cross piece may be conveniently and inexpensively constructed from detachable polyvinylchloride conduit elements.

10 Claims, 4 Drawing Sheets

(56) References Cited

U.S. PATENT DOCUMENTS

| | | | | |
|---|---|---|---|---|
| 6,725,851 | B1 * | 4/2004 | Graf | 124/44.5 |
| 7,748,369 | B2 | 7/2010 | Chee | |
| 7,997,261 | B2 * | 8/2011 | Scaniffe | 124/87 |

* cited by examiner

COMBINED CENTERFIRE SLINGBOW AND QUIVER

CROSS-REFERENCE TO RELATED APPLICATION

This application claims all benefits under 35 U.S.C. 119(e) of Provisional Patent Application Ser. No. 61/719,640 entitled Combined Centerfire Slingbow and Quiver, filed Oct. 29, 2012, herein incorporated by reference in its entirety and for all purposes.

FEDERALLY SPONSORED RESEARCH

Not Applicable

SEQUENCE LISTING OR PROGRAM

Not Applicable

BACKGROUND

Field

The present disclosure relates generally to archery and, more specifically to a portable slingbow apparatus for launching as well as carrying and storing arrows.

Related Art

This section is intended to introduce aspects of existing technology that may be in some way related to aspects of the present disclosure to be presented in more detail and claimed herebelow. This section further provides context and background information purposed to facilitate a better understanding of the present disclosure, and not admissions of prior art under applicable parent law statutes.

A number of devices presently exist that address the necessity for a compact, arrow launching apparatus, though most have utilized variations of either the traditional sling-shot or more refined versions of projectile launchers known commercially, e.g., as Wrist-Rockets®, and more recently modified with various types of attachable arrow-rest and guide elements and apertures enabling their use as arrow launching devices. For example, U.S. Pat. No. 2,715,895, issued to Loveless for "Sling Shot" is a conventional sling-shot adapted for use in launching an arrow. Halverson's U.S. Pat. No. 2,876,760 entitled "Catapult Device" also utilizes a conventional sling-shot, but introduces a modified bolt or shortened arrow which attaches to the propelling medium at the fore end rather than the nock (i.e., notch at the arrow's aft or trailing end).

Saunders' U.S. Pat. No. 3,018,770, entitled "Sling Bow," elaborates on earlier models by incorporating an arm rest and guide element to steady the launching apparatus as the sling is pulled and the arrow is released. Other patent documents including Dantzler's U.S. Pat. No. 3,524,439 for "Catapult," Stribling's U.S. Pat. No. 2,807,254 for "Sling Shot," and Olson's U.S. Pat. No. 4,877,007 for "Sling Bow" recognized the advantage and need for a more compact and portable device for launching arrows. Most of the latter are concerned with using traditional sling-shots and adding various types of arrow rest and guide elements and apertures designed to hold and steady an arrow as it is drawn and launched.

Olson's "Sling Bow," mentioned hereabove, elaborates upon previous devices to allow for quick adjustment between left and right hand shooting, and adds a more agile arrow rest and guide element configured to lessen any affect on arrow flight. Pfotenhauer's U.S. Pat. No. 3,949,729 presents an "Elastic band Guided Article Projecting Device" utilizing rubber bands for launching a projectile from a cross-bow style device. No combined quiver/bow structure is included in the aforementioned devices. Chee's U.S. Pat. No. 7,748,369 describes a "Launching Apparatus and Assembly" wherein projectile-retaining quivers are disclosed as ancillary to the launching device, but these quivers clearly are intended to be worn on the user's arm, leg or waist where they remain physically independent of the launch device itself.

These previously granted patents are generally related to the present invention, but do not present the advantageous details as now will be described herebelow. For example, while Olson provides a projectile launcher that can be adjusted by its operator to accommodate right or left-handedness, it is not inherently ambidextrous (as described herein), and does not incorporate an extended rear aperture housing structure as a brake to prevent or minimize wrist slap (as will be described herebelow). Moreover, above-noted projectile launching devices do not physically combine the launching apparatus and quiver, nor utilize the quiver structure as the launching device.

BRIEF SUMMARY OF THE DISCLOSURE

This disclosure is directed to the field of archery and introduces a compact and portable projectile launching apparatus. The presently disclosed apparatus offers a number of unique advantages over pre-existing arrow (or equivalent projectile, henceforth "arrow") launching equipment as well as convenient improvement in the manner in which arrows and the like are stored in relation to an archery slingbow. An important advantage which the presently disclosed device holds over conventional archery bows and handheld slingbow devices is its compact, self-contained centerfire aperture configuration that eliminates or minimizes what is known in the archery field as archer's paradox. Generally, this term refers to the effect produced by an arrow flexing as it is launched by the bow.

Another unique feature is the auxiliary use of the slingbow structure as a quiver or other containers which afford the user (archer) the convenience of storage and transport of items, particularly arrows but also including other items) within the slingbow structure itself. For example, the slingbow member has a generally linear extension from its first end (i.e., upper generally cylindrical arm) to its second end (lower generally cylindrical arm), and interconnected at a generally central area by a cross piece. Within the upper arm a quiver is structurally defined as a capped container for secure and handy arrow supply. Within the cross piece, a centerfire aperture is defined as will be further discussed below.

At least one additional capped container can be structurally defined at a second slingbow end portion (within the lower generally cylindrical arm) and made available for storing other items commonly needed by archers in the field. As a whole, the (at least one) internal container serves to structurally define the slingbow structure as a unitary rigid implement capable of multiple uses. In fact, the rigidly constructed slingbow presented herein can be deployed as (or structurally combined with) a walking staff.

The above-mentioned cross piece (to which upper and lower generally cylindrical arms of the slingbow are attached) is configured to define therein an arrow-receiving, rest and guide structure generally described herebelow as a cross piece chamber. This chamber extends within the cross piece both fore (i.e., in a forward firing direction toward target) and aft (rearwardly toward shooter), and is configured at its rear end to receive an arrow (or similar projectile). Gently retained (in a manner to be described) within this chamber the arrow awaits being nocked onto a latex band (or bands) via a nocking segment affixed to said band(s). The arrow rest feature is particularly important to the full functionality of the presently described slingbow combination. Important, too, is the cross piece rearward extent.

As noted hereabove, the cross piece chamber extends in a first direction coincident with an intended line of fire and includes (along said first direction) a unique arrow rest and guide element centrally secured within the chamber. The arrow rest and guide element comprises at least one band of pliable, inwardly extending bristles. As noted above, the cross piece chamber extends rearwardly (in a direction opposite said forward direction and toward the shooter). At its rearmost extent, the cross piece chamber is adjacent the latex launching band stretched thereacross to intersect and interconnect to the projectile launching latex band interconnected to slingbow terminal ends.

Thus, besides receiving arrows for launching, rearward extension of the cross piece serves a secondary purpose in blocking or minimizing wrist slap—a term vividly describing the unwelcome impact of the slingbow band along the user's forearm and wrist area upon arrow launch. In the archery field, a bracer or protective sleeve is widely relied upon as the sole means of avoiding wrist slap injuries.

The configuration of the cross piece and cross piece chamber with its centerfire aperture inherently accommodates ambidextrous use with little or no apparatus adjustment (with possible exception of repositioning the upper arm sighting mechanism). Other useful features include adjustably positioned compression clamps, each of which secures an end of the launch band (latex or the like) to respective ends of the slingbow structure (i.e., upper or lower cylindrical arms). Purposeful adjustment of these compression clamps allows launch band draw weight to be altered to provide differing draw lengths and accommodate varying body strengths of archers.

BRIEF DESCRIPTION OF THE DRAWINGS

Advantages of the invention may become apparent upon reading the following detailed description and upon reference to the drawings in which.

LIST OF PARTS

Figure 1:
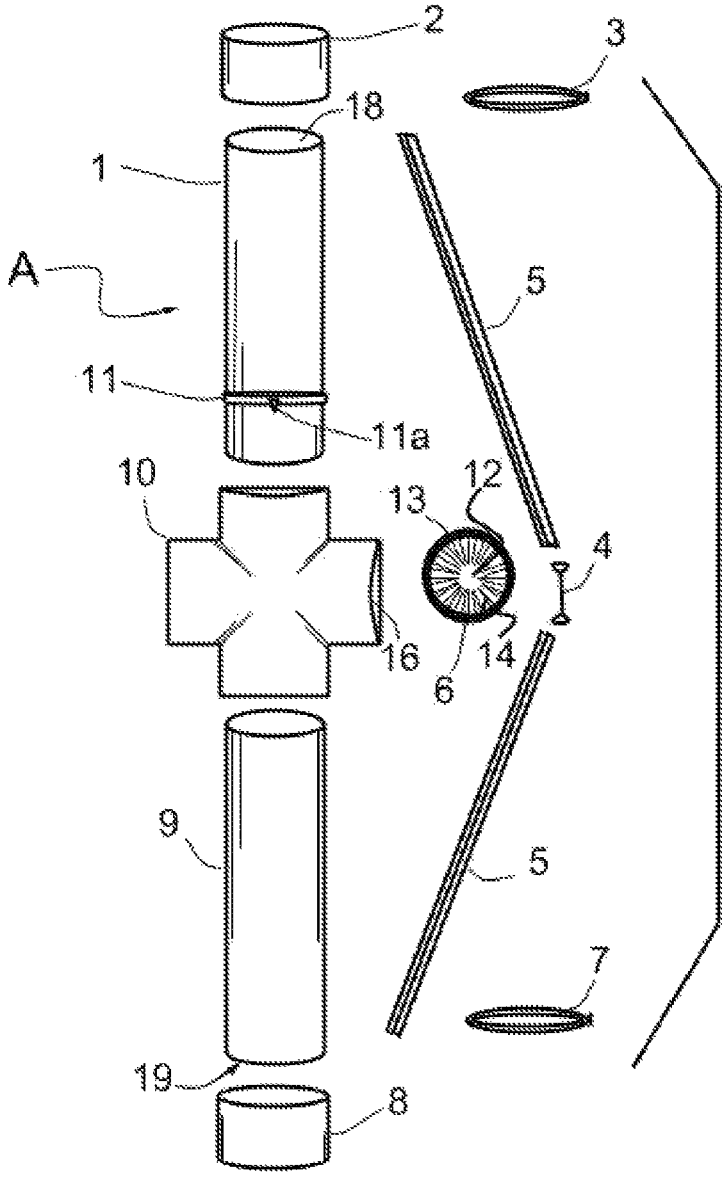
FIG. 1 is an exploded right side perspective view of the combined centerfire slingbow and quiver.

A—Centerfire Slingbow and Quiver
1—upper arm
2—upper cap
3—upper compression clamp
4—nocking segment
5—latex band(s)
6—arrow rest and guide element
7—lower compression clamp
8—lower cap
9—lower arm
10—cross piece
11—sighting mechanism
11*a*—sight bead
12—centerfire aperture
13—polyester band
14—pliable bristles
15—arrow(s)
16—cross piece chamber
18—quiver (arrow storage area)
19—other storage area
G1—user grip 1
G2—user grip 2

DETAILED DESCRIPTION OF SPECIFIC EMBODIMENT

Reference will now be made in detail to embodiments of the invention illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, upper, lower, left, right, up, down, over, above, below, beneath, rear, and front, may be used with respect to the drawings. These and similar directional terms are no more than aids to facilitate the reader's understanding the structure described and not to be construed as limiting invention scope of the invention in any manner.

It should be appreciated that in the development of any such actual implementation, as in any engineering or design project, numerous implementation-specific decisions must be made to achieve the developer's specific goals, such as compliance with system-related, sports or business-related constraints, which may vary from one implementation to another. Such would be a routine undertaking of design, fabrication, and manufacture for those of ordinary skill in the art and having the benefit of the present disclosure.

Figure 5:
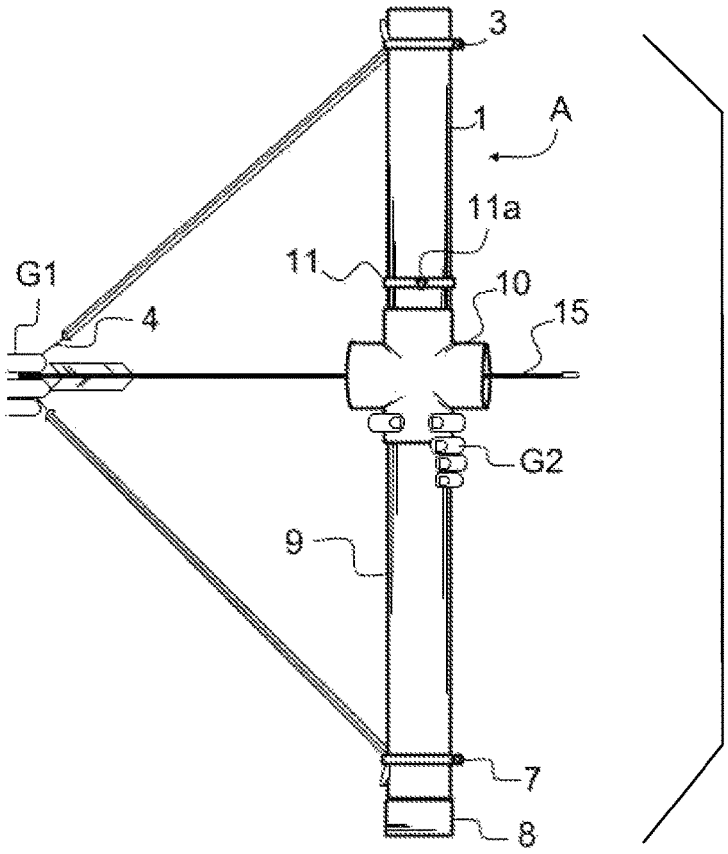
FIG. 5 a right side elevation view of the combined centerfire slingbow and quiver in use by a right-hand shooter, and with quiver upper cap removed.

The combined centerfire slingbow and quiver A (depicted as disassembled or exploded parts in FIG. 1 and as operationally ready in FIG. 2) includes a generally central cross piece 10 with an inner cross piece chamber 16 wherein is defined a centerfire aperture 12. Aperture 12 extends in a first, firing direction as depicted in FIGS. 2 and 5. Cross piece 10 is interconnected at a first side thereof to slingbow A first portion depicted in FIG. 2 et seq. as an upper tube 1 extending upwardly of said cross piece 10. Cross piece 10 similarly is interconnected at a second side thereof to slingbow A second portion depicted in FIG. 2 et seq. as a lower tube 9 extending downwardly of said cross piece 10.

Upper tube 1 is capped snugly by removable upper cap 2, and fits snugly into a first side (upper) opening of cross piece 10. Lower tube 9, which is capped snugly with lower cap 8, fits snugly into a second side (lower) opening of cross piece 10. To afford take-down and storage, these parts may interconnect via friction-fit (also known as interference fit), threaded connection, rib/notch detent connection and/or equivalents thereof. Cap 2 closes an upper storage area within upper tube 1. This closable storage area is particularly suitable as a quiver 18 for a supply of arrows and the like. Lower tube 9 is configured with a similar cap 8 resulting in storage area 19 for other items such as rain slicker, food, water, equipment repair materials and so forth. Together, the centerfire slingbow and quiver assembly is suitable for use as a walking staff or discrete portion of such a staff.

Figure 2:
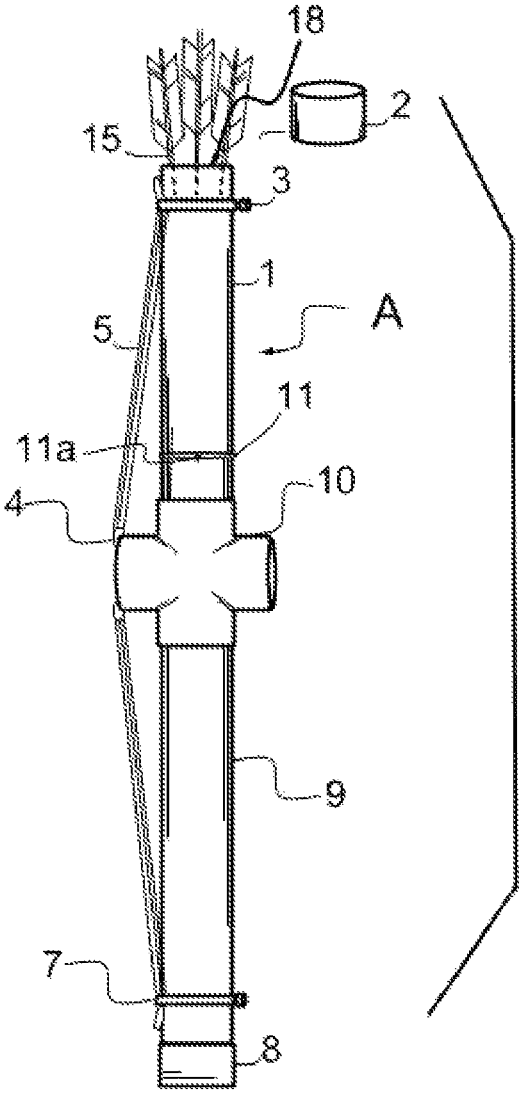
FIG. 2 is a right side elevation of the combined centerfire slingbow and quiver, with sighting mechanism set for right-hand shooter and with quiver upper cap removed.
Figure 3:
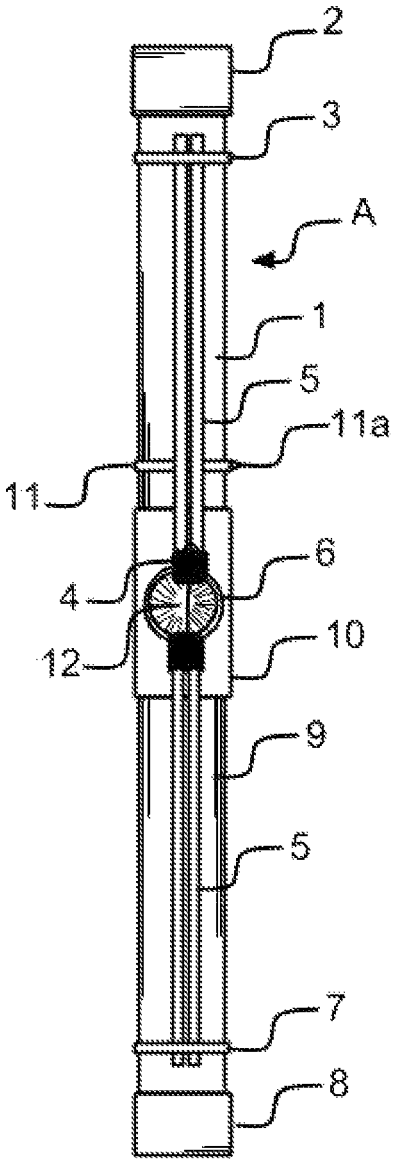
FIG. 3 is a rear (posterior) elevation of the combined centerfire slingbow and quiver (from the archer's viewpoint), with sighting mechanism set for right-hand shooter.

At least one projectile launching latex band 5 (a paired band set is depicted in FIGS. 1 and 3) interconnects slingbow A terminal ends of arms 1, 9. More specifically, outer ends of latex bands 5 are fastened to generally cylindrical upper arm 1 and lower cylindrical arm 9 by means of releasable compression clamp fasteners 3 and 7, respectively. This enables band 5 adjustment along tubes 1, 9 (toward and away from outer ends thereof) to alter the draw weight of slingbow A. When assembled, the latex band 5 is located on a side of said centerfire slingbow A opposite said first, firing direction such that said band can be stretched by the archer/user in said second direction storing energy for subsequent release in said firing direction. As depicted in FIGS. 1, 2, 3 and 5, multiple arrow-launching latex bands may be combined in parallel and jointly interconnected to respective ends of slingbow A and a central nocking segment 4 (to be described herebelow).

As illustrated in FIG. 3, arrow launching latex band 5 may advantageously include a projectile/arrow nocking segment 4 positioned generally along the band 5 extent between first and second terminal ends (adjacent outer extent of upper and lower arms 1,9). Nocking segment 4 would be adjustably positioned so as to ensure it is directly adjacent said defined centerfire aperture 12 wherein an arrow will be inserted. This enables the nocking segment 4 to be fittingly engaged with an arrow nock (FIG. 5) in preparation for firing release, ensuring alignment of band 5/segment 4 launch forces with respect to centerfire aperture 12 and arrow rest and guide element 6.

Figure 6:
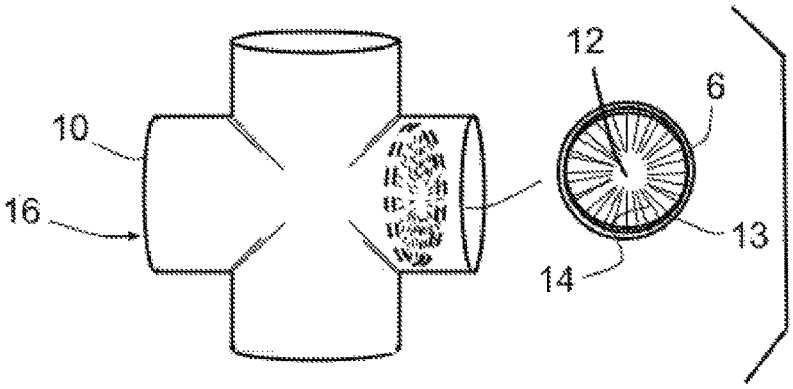
FIG. 6 is a right side perspective, exploded view of firing chamber arrow rest and guide element detail.

As suggested in FIG. 6, arrow rest and guide element 6 is fastened (e.g., secured by adhesive, interference "fit" as above-described, or set screws—not shown) within the forward (toward target) opening of cross piece 10 chamber 16. Arrow rest and guide element 6 may be a polyester or plastic malleable band 13 formed into a closed loop and secured to an inside surface of chamber 16. Other equivalent materials clearly could be substituted as long as they do not damage the arrow or alter its projection speed and course. Details of a rest/guide embodiment now will be presented.

Figure 4:
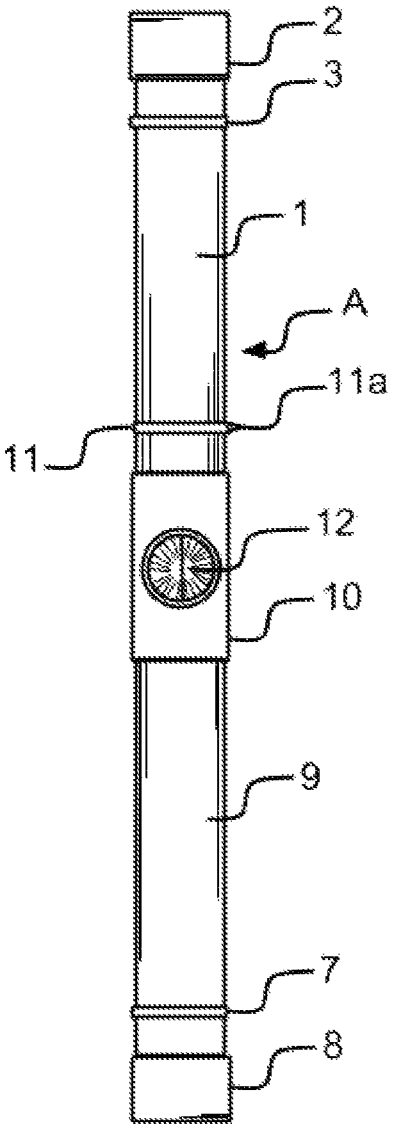
FIG. 4 is a front (anterior) elevation of the combined centerfire slingbow and quiver, (i.e., with slingbow facing in shooting direction) and with sighting mechanism re-set for left-hand shooter.

As depicted in FIGS. 3, 4, and 6 polyester or plastic bristles 14 which are both pliable and flexible are inserted radially through perforations (not shown) on band 13 in order to form a pliable arrow rest and guide element 6. At their innermost radial extent, inwardly projecting tips of bristles 14 define the breadth of centerfire aperture 12. Bristles 14 are fabricated to be sufficiently rigid to gently support and steady the arrow within the central cross piece 10 in its fire-ready position within chamber 16. Bristles 14 must also be sufficiently pliable or flexible to afford unobstructed and non-damaging passage of the arrow 15 so as to neither alter the arrow's flight nor damage its fletching.

The shooter employs the adjustable sighting mechanism 11 positioned on the outer face of arm 1 to align the inserted arrow with a target (see FIG. 5). Sighting mechanism 11 is shown in FIG. 1 as having a sight bead 11*a* positioned for use by a right-handed shooter. Mechanism 11 may be a compression clamp configured to be interconnected to slingbow A upper arm 1. When desired, sighting mechanism 11 may be loosened (as necessary) and twisted to place its bead 11*a* at a higher or lower position to accommodate height of different users. To serve both left-handed and right-handed shooters, sight bead is adjustably slidable to an opposite outer face of upper tube 1. Note with respect to posterior view FIG. 3 from shooter's perspective the sight bead 11*a* accommodates a right-handed shooter, as contrasted with anterior view FIG. 4 where sight bead 11*a* accommodates a left-handed shooter.

The simplicity of cross piece chamber 16 design and centerfire aperture 12 configuration allow for a broad range of arrow sizes by eliminating the need to pre-measure "spine" or other metrics often demanded for accurate shooting with conventional bows. This feature also precludes the need to purchase more expensive arrows that must bear the costs of measuring spine, weight and length to fit a particular bow.

While proper use of the presently described combined centerfire slingbow and quiver should be readily appreciated, the following explanation is offered to complete a full explanation of the present contribution to archery. The following steps would typically be pursued. First, user removes upper cap 2 and withdraws an arrow 15 (see FIG. 2) from where it is stored in quiver 18 fabricated within slingbow upper arm 1. The user inserts arrow 15 through centerfire aperture 12 preferable from the rear of cross piece chamber 16, to a position where arrow 15 is gently supported in steady rest on bristles 14 of arrow rest/guide element 6; then nocks the arrow with nocking segment 4 which is interconnected with band(s) 5.

As shown in FIG. 5, user grasps the slingbow lower arm 9 along with a lower portion of cross piece 10 with her/his non-firing hand at G2 (hand choice depends on whether user is left-handed or right-handed) to steady the combined centerfire slingbow and quiver A. She/he next grasps the nocking segment 4 with firing hand at G1, utilizing either the two finger method (index and middle finger) or the three finger method (index, middle and ring finger) or an archery release (not shown).

Steadying the arrow 15 with fingers of the non-firing hand, user nocks the arrow onto nocking segment 4 with the firing hand. Using either fingers or an archery release, the user draws the arrow back to an anchor point and holds it at firing position (FIG. 5) while steadying and aiming the device with the non-firing hand and aligning the adjustable sighting bead 11*a* with the shooting eye. When user is comfortable with aim and draw, the arrow is launched by releasing the fingers of the firing hand or engaging a trigger mechanism of the archery release (not shown)

Latex bands 5 with associated nocking segment 4 instantly advance forward with considerable force and speed until braked by the rearwardly extended end of cross piece 10. Thus, with this unique arrangement, bands 5 and nocking segment 4 impart force to the launching arrow but are prevented by the rearward extension of cross piece 10 from striking the user's forearm and wrist.

Alternative Embodiments

The centerfire slingbow and quiver A as described can be simply and inexpensively manufactured of polyvinyl chloride (PVC) other plastics, wood, certain metals or combinations of these materials. Component parts thereof can be removably interconnected as suggested above, so as to be wholly collapsible with separable parts configured in a rapid takedown design. Some components thereof obviously can be stored within at least one of said compartments in arms 1 and 9. This feature of course enhances portability as the apparatus can be entirely broken down into its component parts for carrying and storage, and just as quickly reassembled for use.

Moreover, utilizing interchangeable components also allows the centerfire slingbow and quiver A to be repaired by replacing worn or cracked parts as necessary. Longer or shorter upper and lower arms 1, 9 may be deployed with a common cross piece 10, accommodating alternate users or a specific user's special needs. Alternatively, the body of the device can be manufactured as an integral unit combining elements selected among parts 1, 9, 10, 11 with injection-molded plastic or other method as appropriate, particularly if pricing models or strength testing so requires.

Overall length of the centerfire slingbow and quiver A may vary depending on users' height/strength range and draw length requirements. Upper cap 2 can be omitted as necessary to accommodate longer arrows which would protrude over the top of the upper tube 1 (see FIG. 2). Storage area within arm 9 could accommodate additional and/or different arrows/projectiles. For use in a more "fire-ready" mode, additional arrows 15 may alternatively be carried outside the apparatus in an external quiver, rather than inside the cylindrical tubes.

The diameter of generally cylindrical arms 1 and 9 can vary depending on shooter preference, draw weight, number of quivered arrows 15, hand-grip (girth) capacity of shooters, and any other consideration for these and other relevant needs for variance in diameter, size and strength. Moreover, these arms 1, 9 may be embodied in a variety of shapes and cross-sectional profiles other than generally cylindrical, bearing in mind the necessity of maintaining critical strength against material failure.

The cross piece 10 with its chamber 16, and any other load-bearing components, can be lengthened, made with increased thickness, or made with stronger resins or other components to accommodate higher weight draws for larger and stronger shooters, and to allow a greater draw weight for a particular shooter.

Alternatively, the number and/or strength of the elastic or latex bands 5 may be increased or decreased to change the power and durability of the band as well as the force imparted to the projectile. The paired band 5 presented herein is merely an example.

Another alternative embodiment for the present invention is its use as the upper portion of a walking staff for hiking and climbing, and which can afford storage capacity for emergency or survival gear in hollow portions of the sling bow structure that make up the staff.

A more robust sighting mechanism 11 can be utilized depending upon the level of expertise and required accuracy and consistency of the shooter. The standard sighting mechanism 11, or an alternative, can simply be rotated to the left or right side to accommodate a left-handed or right-handed shooter.

The present invention can be utilized for bowfishing, as its structure provides for the easy attachment of a fishing reel that can be attached to a bowfishing arrow with simply two additional compression clamps to upper/lower tube or cross piece 10.

Although various disclosure embodiments have been described in the foregoing detailed description and illustrated in the accompanying drawings, it will be understood that the presently disclosed invention is not limited to the embodiments disclosed, but indeed may assume numerous arrangements, re-arrangements, modifications, and substitutions of elements or steps without departing from the spirit and intended scope of the invention herein set forth and claimed.

I claim:

1. A combined centerfire slingbow and quiver wherein:

a pair of generally rigid cylindrical arms is interconnected to a generally cylindrical cross piece to form a rigid bow member such that said cross piece is generally central of said bow member;

a first of said pair of arms is attached to an upper side of said cross piece from which said first arm extends to its upper terminal end;

a second of said pair of arms is attached to a lower side of said cross piece from which said second arm extends downwardly to its lower terminal end;

said generally cylindrical cross piece is configured to include an internal chamber which is open at a rear end and front end thereof, respectively, to receive and release a first arrow in preparation for its launch, and which is wide enough to permit fletching on the first arrow to pass therethrough;

said cross piece chamber extends in an arrow firing direction generally perpendicular to said extended upper and lower cylindrical arms;

said cross piece internal chamber has secured therein at least one pliable arrow rest and guide element configured to inwardly define a centerfire aperture extending in said first arrow firing direction, said pliable arrow rest and guide element serves to support and steady the first arrow, including fletching, and allows the first arrow to pass unobstructed and undamaged when launched by said slingbow;

at least one of said first and second cylindrical arms includes an elongated internal storage compartment extending to said terminal end thereof;

at least one arrow launching latex band is attached to said terminal ends of said bow member so as to be located on a side of said bow member opposite from said firing direction such that said at least one latex band extends adjacent said cross piece chamber rear end, such that said band is stretched opposite said firing direction and released to launch the first arrow supported within said crossfire chamber while said cross piece rear end guards said user against wrist slap injury by said latex band; and while the latex band is stretched and released to launch the first arrow, the first and second rigid cylindrical arms remain substantially linear, thereby permitting at least a second arrow to remain disposed within the elongated internal storage compartment without being damaged.

2. The combined centerfire slingbow and quiver of claim 1 further defined as including a removable cap for said internal storage compartment.

3. The combined centerfire slingbow and quiver of claim 1 wherein said at least one projectile launching latex band includes:

a projectile nocking segment affixed thereto so as to be generally centrally positioned along said at least one latex band extended between said first and second slingbow terminal ends, and directly adjacent to said defined centerline aperture;

whereby an arrow nock can be fittingly engaged on said arrow in preparation for firing.

4. The combined centerfire slingbow and quiver of claim 3 further defined as comprising:

multiple launching latex bands arranged in parallel and jointly interconnecting said nocking segment and rigid bow member terminal ends respectively.

5. The combined centerfire slingbow and quiver of claim 1 wherein said pliable arrow rest and guide element is further defined as including:

a malleable band formed into a closed loop secured to an inside surface of said centerfire chamber;

said band including pliable bristles inserted radially therethrough with inwardly projecting bristle tips defining said centerfire aperture;

whereby said pliable arrow rest and guide element serves to support and steady an arrow and allows the arrow to pass unobstructed and undamaged when launched by said slingbow.

6. The combined centerfire slingbow and quiver of claim 1 wherein:

said generally cylindrical arms and generally central cross piece are releasably interconnected to facilitate take down and storage.

7. The combined centerfire slingbow and quiver of claim 1 wherein:

said generally cylindrical arms and generally central cross piece comprise interconnected polyvinyl chloride conduit units.

8. The combined centerfire slingbow and quiver of claim 7 wherein said polyvinyl chloride units are releasably interconnected for convenient takedown and storage.

9. The combined centerfire slingbow and quiver of claim 1 further defined as including:

a sighting mechanism releasably attached to a first side of said first slingbow portion so as to extend laterally of said defined centerfire chamber;

said sighting mechanism is adjustably moveable to a second side of said first slingbow portion opposite said first side;

whereby said centerfire slingbow can be readily adjusted to accommodate use by either left-handed or right-handed shooters.

10. The combined centerfire slingbow and quiver of claim 1 further defined by:

said at least one arrow launching latex band is interconnected to arm terminal ends by adjustable compression clamps;

whereby said compression clamps can be adjusted toward and away from said terminal ends to increase or decrease draw weight of said slingbow.

* * * * *